United States Patent [19]

Bernbaum

[11] Patent Number: 4,588,056

[45] Date of Patent: May 13, 1986

[54] COLLAPSIBLE ARTICLE OR LUGGAGE

[76] Inventor: L. Harrison Bernbaum, 470 Madison, Glencoe, Ill. 60022

[21] Appl. No.: 600,836

[22] Filed: Apr. 16, 1984

[51] Int. Cl.[4] ..... A45C 7/00; A45C 13/04

[52] U.S. Cl. ..... 190/107; 190/127

[58] Field of Search ..... 190/107, 127, 103; 229/41 R

[56] References Cited

U.S. PATENT DOCUMENTS

| | | | |
|---|---|---|---|
| 726,941 | 5/1903 | Kertz | 229/41 R X |
| 1,273,875 | 7/1918 | Kosta | 190/127 |
| 1,573,721 | 2/1926 | Loeffler | 190/107 |
| 2,373,573 | 4/1945 | Langford et al. | 190/127 X |
| 2,405,361 | 8/1946 | Langford et al. | 190/127 X |
| 2,425,035 | 8/1947 | Garnett et al. | 190/107 |
| 2,560,297 | 7/1951 | Lifton | 190/103 X |
| 3,165,178 | 1/1965 | Pelavin et al. | 190/127 X |
| 4,160,496 | 7/1979 | Knight | 190/107 |
| 4,210,230 | 7/1980 | Weiner | 190/107 |
| 4,350,194 | 9/1982 | Brown | 206/315.5 |

FOREIGN PATENT DOCUMENTS

| | | | |
|---|---|---|---|
| 1020271 | 11/1957 | Fed. Rep. of Germany | 229/41 R |
| 1174502 | 3/1959 | France | 190/127 |

*Primary Examiner*—Steven M. Pollard
*Assistant Examiner*—Sue A. Weaver
*Attorney, Agent, or Firm*—Edward D. Gilhooly

[57] ABSTRACT

A collapsible bag or article of luggage having internal stiffening panels capable of forming a rigid configuration. The stiffening panels may be released to an unsecured position in which the article can assume a collapsed configuration. In its reinforcing position, the stiffening panels are anchored by an elongated retaining member affixed thereto.

7 Claims, 6 Drawing Figures

FIG. 1
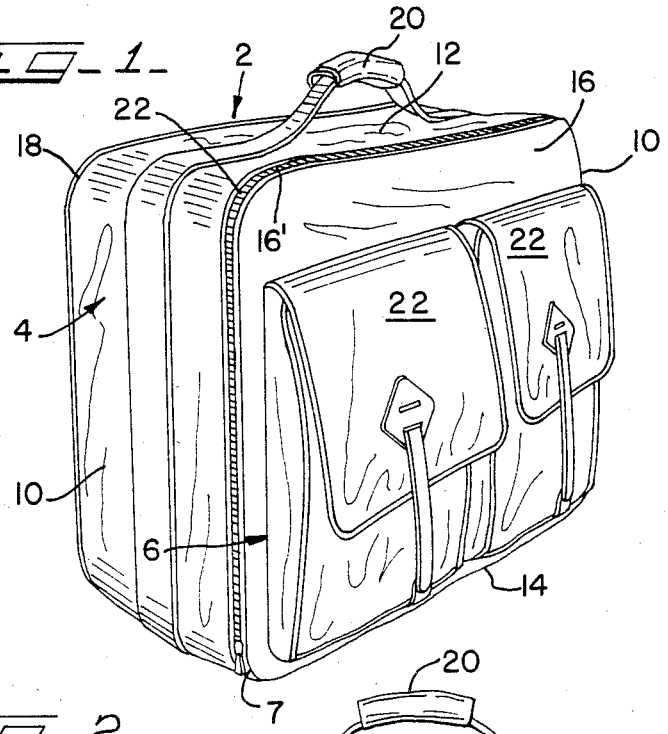
FIG. 2
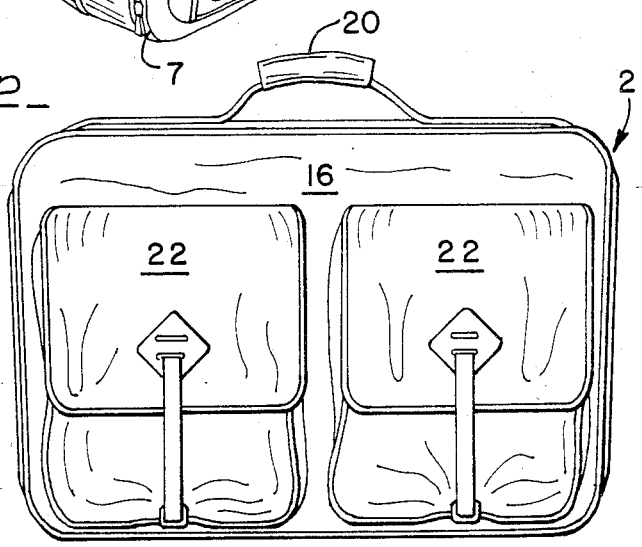
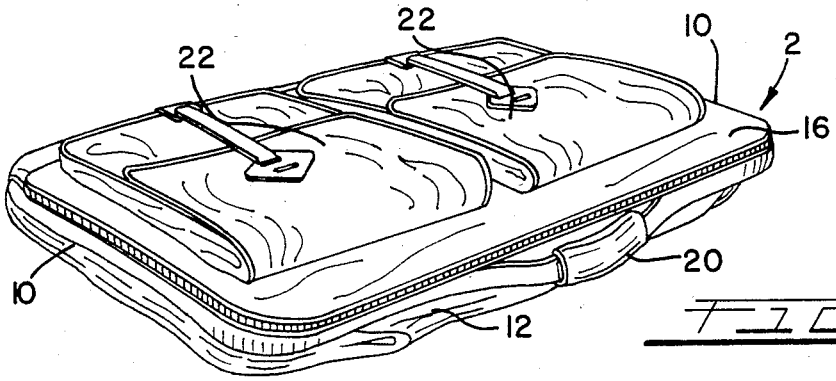
FIG. 5

COLLAPSIBLE ARTICLE OR LUGGAGE

BACKGROUND OF THE INVENTION

This invention relates in general to articles of luggage and bags and, in particular, to an improved article of luggage or bag having a collapsible construction.

More specifically, but without restriction to the particular use which is shown and described, the invention relates to a collapsible article of luggage or bag in which a pair of pivotally mounted reinforcing panels permit the luggage to assume either a rigid or semi-rigid configuration or a collapsed space-saving shape.

A typical rigid or semi-rigid piece of luggage is bulky in size when shipped or stored in an empty condition. The fixed external dimensions of known constructions increase the volume occupied during shipment between and from the manufacturer or seller and further interfere with the convenient space-saving storage of the bag at home or elsewhere by the user. Attempts have been made in the past to provide a bag having a collapsible design when empty for economical shipment and convenient storage. Examples of prior art designs are disclosed in the patent to Zoland, U.S. Pat. No. 4,142,564; and Kertz, U.S. Pat. No. 726,941.

Such known collapsible constructions are provided with a stiffening insert to create a structure of fixed dimensions. Past collapsible designs, such as shown in the Zoland and Kertz patents, however, suffer from several defects that rendered them unsatisfactory for widespread use. Prior bags of the knock-down type are either inconvenient to use or rely on impractical designs.

For example, in known techniques, the expansible bag insert is not suitably anchored in the erected bag. In an expanded form, it is desirable that the bag maintain that configuration without collapsing when carrying any articles during transport or handling. Because of the prior ineffectiveness of securing the expandable member(s) in such articles, accidental collapse is possible in transport and handling.

Known bags can further only be erected if it is nearly void of all articles. In some situations, however, a bag may need to be expanded from a collapsed form to a more rigid form when at least some items are present within the bag through oversight, dislodgement and the like. In addition, some known knock-down luggage is physically designed in a manner adversely affecting its ability to accommodate items within the bag because of interfering cross structure and the like.

SUMMARY OF THE INVENTION

It is therefore an object of the present invention to provide an improved collapsible bag with expandable members.

Another object of the present invention is to firmly anchor the expanding panels to maintain an erect configuration.

These and other objects are attained in accordance with the present invention wherein there is provided an improved collapsible bag or piece of luggage having a pair of swinging panels which can be anchored to form a rigid or semi-rigid configuration for carrying items. The pair of panels are secured by a hinged member arranged to be connected to the pivoted panels to provide dimensional reinforcement of the structure. The luggage of the invention provides valuable space-saving collapsible capabilities, while also being able to serve satisfactorily as a sturdy, effective piece of luggage.

DESCRIPTION OF THE DRAWINGS

Further objects to the invention and objects accruing therefrom will be apparent from the following description of a preferred embodiment of the invention which is shown in the accompanying drawings with like reference numerals indicating corresponding parts throughout, wherein:

FIG. 1 is a front perspective view of the collapsible luggage of the invention;

FIG. 2 is a front schematic view of the luggage of FIG. 1;

FIG. 5 is a top perspective.view of the bag of FIG. 1 in a collapsed configuration.

DESCRIPTION OF A PREFERRED EMBODIMENT

Figure 3:
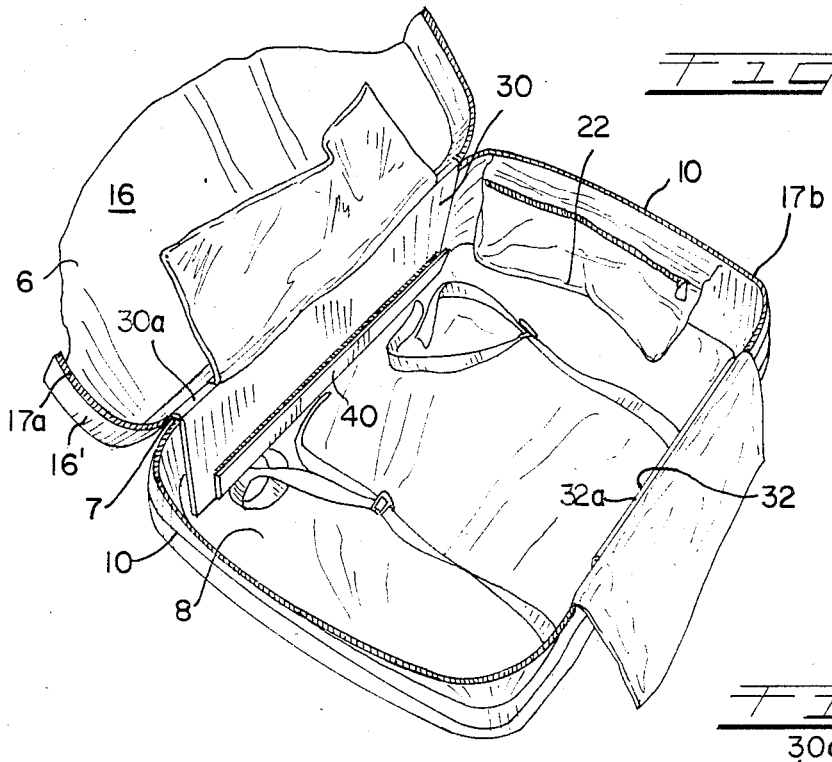
FIG. 3 is a partial top perspective view of the luggage of FIG. 1 in an open configuration with the expandable member in a secured position.
Figure 4:
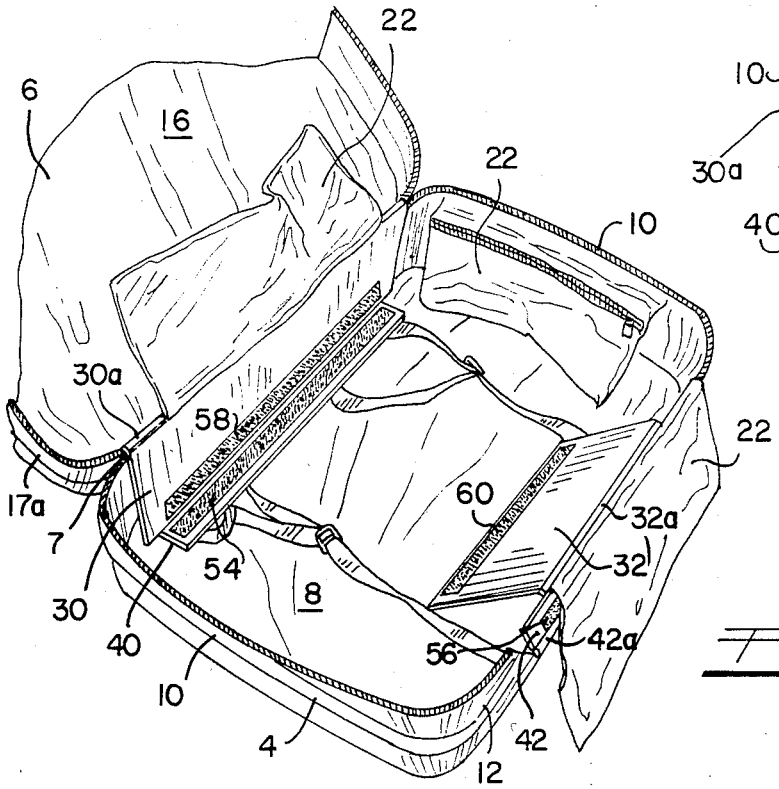
FIG. 4 is a top perspective view of the bag of FIG. 3 with the erecting panels in a released condition.

Referring now to the drawings, there is illustrated the collapsible luggage or bag of the invention, generally designated by reference numeral 2. The bag 2 may be constructed from any suitable material, such as a fabric, canvas, leather, various plastic compositions, and the like. Although the bag or luggage 2 can encompass other constructions and designs, base section 4 and cover section 6 are integrally hinged together along connecting portion 7 (FIG. 4) to form an integrally coupled container capable of being closed, as shown in FIG. 1, or opened by swinging cover section 6 away from the base section 4 as in FIG. 4. The base section 4 provides an article receiving compartment 8 which is defined and integrally formed by end walls 10, top wall 12 and bottom wall 14. As best shown in FIGS. 3 and 4, cover section 6 is formed with a top panel 16 having a continuous projecting border section 16'. Conventional zipper elements **17*a* are affixed to the border section 16' extending from both sides of connecting portion 7**.

Zipper elements **17*a* cooperate with corresponding zipper elements 17*b* continuously affixed along the edges of end walls 10, top portion 12, and around to both sides of connecting portion 7 of base section 4, as seen in FIGS. 3 and 4**.

The front panel 16 of cover section 6, and the rear side panel 18 of base section 4 are constructed as a rigid or reinforced member capable of essentially maintaining a rigid or semi-rigid configuration. Side walls 10 and top and bottom portions 12 and 16 are not internally reinforced or semi-rigid in construction, and are capable of being collapsed in an accordian-like manner, as shown in FIG. 5, as will be apparent. As can be seen in FIG. 1, the bag 2 can be provided with a typical handle structure 20 and a pair of external and internal compartments or pockets 22, as is well known.

Figure 6:
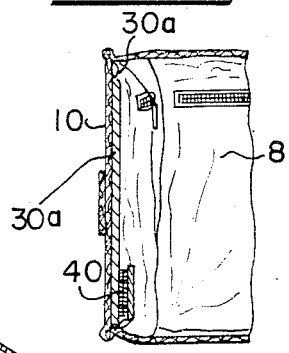
FIG. 6 is a partial end view, with parts in section, of one of the erecting panels of the invention.

Referring now to FIGS. 3, 4, and 6, the erecting or reinforcing members of the invention are illustrated. The reinforcing members comprise a pair of rigid panels 30 and 32 of equal or unequal length, which are sewn or otherwise attached to internal portions of the bag 2 adjacent compartment 8. Flexible strips of material **30*a*, 32*a* are respectively affixed to an edge portion of panel members 30 and 32 and are sewn or otherwise attached internally of the bag 2 respectively adjacent section connecting portion 7 and top wall 12. The reinforcing panels 30, 32 then are capable of swinging movement due to their attachment to the bag by flexible flaps, allowing the panels to be lifted away from the position shown in FIG. 4, to be arranged in a position essentially parallel to walls 12 and 14. A pair of retention panels 40, 42 formed from a relatively rigid material are sewn adjacent the bottom of walls 12 and 14 and may be swung from a position shown in FIG. 4 to a position shown in FIG. 3. The retention panels 40, 42 may be affixed by hinge strips of flexible material 42***a* in the manner of reinforcing panels 30, 32, if desired.

Strips 54, 56 of Velcro material are disposed along an edge portion of each of the reinforcing panels 40, 42 and are arranged to engage corresponding Velcro strips 58, 60 formed on the retention members 30, 32. The Velcro elements are capable of creating a rigid connection between the respective retention members 40, 42 and the reinforcing or erecting panels 30, 32. Such anchoring of the end of the reinforcing panels 30, 32 expands the bag 2 with a dimensional rigidity through expansible support of collapsible walls 10, 12 and 14.

Although the anchoring panels and erecting panels are secured by means of Velcro strips, as shown in the drawings, it is within the scope of the invention to anchor the two members by any other suitable techique, such as by a series of snaps, zipper elements, posts and cooperating holes and the like.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A collapsible article of luggage comprising:

body means having a pair of opposed panels, said opposed panels being separated by two opposed pairs of interconnected walls defining the width of the body means and an article receiving compartment formed therein;

at least one erecting panel being arranged for operative positioning adjacent said compartment of said body means, said at least one erecting panel being manipulatable to cause said at least one panel to assume an erect configuration or a collapsed configuration; said at least one panel being pivotally attached at an edge portion to said body means along a first axis perpendicular to the width of said body means, said at least one panel being pivotally attached for movement to extend along said width in said erect configuration and to fold approximately against one of said opposed panels in said collapsed configuration, anchor means for releasably anchoring a portion of said at least one erecting panel in said erect configuration;

said means for releasably anchoring comprises a corresponding rigid panel pivotally retained at an edge portion along a second axis lying generally parallel to said first axis, said rigid panel having attachment means arranged to cooperate with corresponding attachement means on said at least one erecting panel.

2. The article according to claim 1 wherein said at least one erecting panel comprises a pair of erecting panels, each of said erecting panels being pivotally mounted along an edge portion respectively along spaced axes extending perpendicular to said width.

3. The article according to claim 2 wherein said pair of erecting panels is mounted for movement within said compartment.

4. The article according to claim 1 said means for releasably anchoring anchors the edge portion of said at least one erecting panel opposite to said one edge portion in said erect configuration of said body means.

5. The article according to claim 1 wherein said at least one erecting panel is affixed to said body means by flexible stips extending along said first axis.

6. The article according to claim 1 wherein said pairs of opposed walls are flexible.

7. The article according to claim 1 wherein said attachment means are cooperating Velcro elements.

* * * * *